United States Patent [19]

Pollak et al.

[11] Patent Number: 4,950,871

[45] Date of Patent: Aug. 21, 1990

[54] ARRANGEMENT FOR HEATING ROOMS UNIFORMLY TROUGH THE EQUALIZATION OF THE TEMPERATURE DISTRIBUTION BETWEEN THE CEILING AND THE FLOOR REGIONS

[76] Inventors: Walter Pollak, Olgastrasse 93, B D-7000 Stuttgart 1; Joachim Förster, Pestalozzistr. 6, D-7012 Fellbach, both of Fed. Rep. of Germany

[21] Appl. No.: 72,976

[22] PCT Filed: Sep. 12, 1986

[86] PCT No.: PCT/EP86/00524

§ 371 Date: Jul. 13, 1987

§ 102(e) Date: Jul. 13, 1987

[87] PCT Pub. No.: WO87/01794

PCT Pub. Date: Mar. 26, 1987

[30] Foreign Application Priority Data

Sep. 13, 1985 [DE] Fed. Rep. of Germany ..... 3532820

[51] Int. Cl.[5] ..... F24H 3/04; F24F 7/06; F24D 9/00; H05B 1/00

[52] U.S. Cl. ..... 219/370; 98/31.5; 126/110 AA; 219/273; 219/366; 219/368

[58] Field of Search ..... 219/366–370, 219/374, 213; 98/29, 31.5, 31.6; 126/110 R, 110 AA

[56] References Cited

U.S. PATENT DOCUMENTS

| | | | |
|---|---|---|---|
| 1,936,914 | 11/1933 | Pitt | 219/370 |
| 1,958,768 | 5/1934 | Ross | 219/370 X |
| 2,471,784 | 5/1949 | Seifner et al. | 219/370 X |
| 2,528,650 | 11/1950 | Graham | 219/370 |
| 2,721,254 | 10/1955 | Burgess | 219/368 |
| 3,111,573 | 11/1963 | Crowe et al. | 219/370 |
| 3,173,353 | 3/1965 | Watkins | 98/31.5 |
| 3,347,025 | 10/1967 | Wiley | 98/31.5 X |
| 3,827,342 | 8/1974 | Hughes | 98/31.5 |
| 4,136,606 | 1/1979 | Wolbrink | 98/31.5 |
| 4,184,415 | 1/1980 | Nicholson | 98/31.5 |
| 4,344,112 | 8/1982 | Brown | 98/31.5 X |
| 4,534,276 | 8/1985 | Allison | 98/31.5 X |

FOREIGN PATENT DOCUMENTS

| | | | |
|---|---|---|---|
| 2738847 | 3/1979 | Fed. Rep. of Germany | 98/31.5 |
| 2931359 | 2/1981 | Fed. Rep. of Germany . | |
| 3148870 | 6/1983 | Fed. Rep. of Germany | 98/31.5 |
| 3306021 | 8/1984 | Fed. Rep. of Germany | 219/370 |
| 3430031 | 2/1986 | Fed. Rep. of Germany | 219/370 |
| 3432200 | 3/1986 | Fed. Rep. of Germany | 219/369 |
| 2494817 | 5/1982 | France . | |
| 129735 | 10/1979 | Japan | 219/370 |
| 57-62336 | 4/1982 | Japan | 98/31.5 |
| 786577 | 11/1957 | United Kingdom . | |
| 899432 | 6/1962 | United Kingdom | 219/370 |
| WO8200190 | 1/1982 | World Int. Prop. O. . | |

*Primary Examiner*—Anthony Bartis

*Attorney, Agent, or Firm*—Jones, Tullar & Cooper

[57] ABSTRACT

An arrangement for the uniform heating of a room, especially a living room, by equalization of the temperature distribution between the ceiling and floor of the room. The arrangement includes at least one upright column extending between the ceiling and floor of the room. Each column comprises two channel-shaped shells fastened to each other which form an air channel in which a fan, which creates an air current from top to bottom, and an electrical heating element are arranged. The fan and electrical heating element are located between an upper air inlet and a lower air outlet. Also included is a control unit which is attached to a front panel. The front panel can be installed and fastened to a front recess of the column, while the fan is fastened to a plate on whose lower surface the heating element in the shape of a tubular spiral body is attached and hung. The heating element is surrounded by a cylindrical air duct and the heating element and fan form a modular unit fastened below the front recess for easy access.

13 Claims, 4 Drawing Sheets

Figure 1:
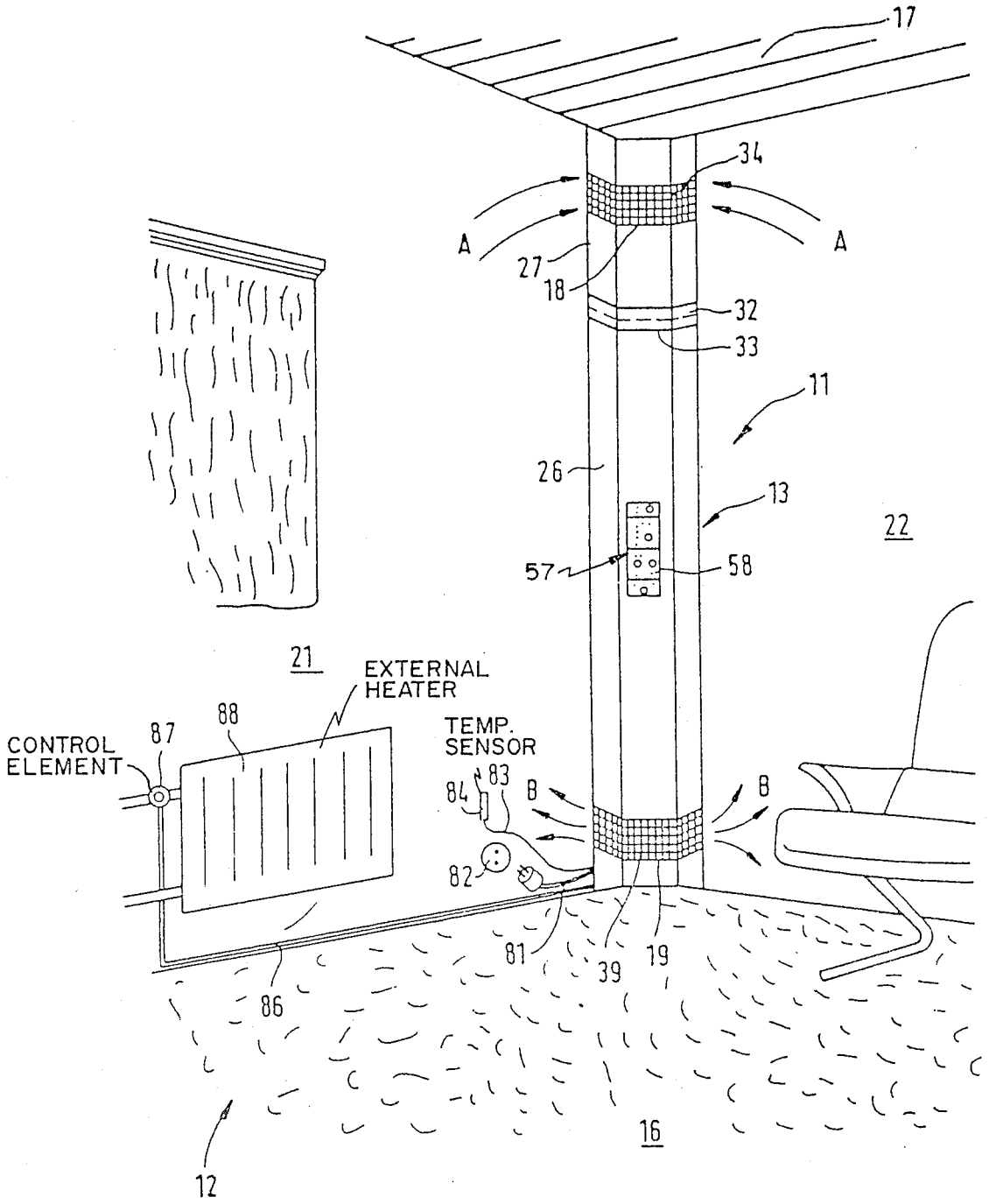

ARRANGEMENT FOR HEATING ROOMS UNIFORMLY TROUGH THE EQUALIZATION OF THE TEMPERATURE DISTRIBUTION BETWEEN THE CEILING AND THE FLOOR REGIONS

The present invention relates to a device or arrangement for heating rooms uniformly, especially heated living rooms, through the equalization of the temperature distribution between the ceiling and the floor regions.

It is known that, as a result of lower density of warmer or hotter air in rooms, a temperature distribution with a temperature gradient takes place, wherein at the floor level the lowest and at the ceiling level the highest temperatures occur. Heating elements are ordinarily arranged at the lower level of a room and warm the air there, which then rises as a result of convection heat, while the colder air flows back from there to the floor. Depending on the height of the ceiling, on the flow ratios, and the heat transmission of the walls, the ceiling temperatures in a heated room may attain, for example, 25° C., while the floor temperature at the same time amounts to 17° C.

This has, for one, the shortcoming that much more heat energy must be expended than would be necessary for the well-being of persons staying in a room. Moreover, indeed, well-being is feigned when seated because at this height, in the cited example, a temperature of about 20° C. reigns, but at the same time, below a level of about one meter, a colder zone remains, which represents a starting point for many illnesses.

The invention thus is rooted in the problem of providing a device or arrangement by which a uniform temperature distribution in rooms may be achieved and at the same time heating energy may be saved. Employed with all known heating methods, an equalization of the temperatures at the ceiling and floor levels should be obtained.

This problem is solved according to the invention by the provision of a device having at least one upright column extending between the ceiling and floor of a room. The column comprises two channel-shaped shells fastened to each other which form an air channel in which a fan, which creates an air current from top to bottom, and an electrical heating element are arranged. The fan and electrical heating element are located between an upper air inlet and a lower air outlet. Also included is a control unit which is attached to a front panel. The front panel can be installed and fastened to a front recess of the column, while the fan is fastened to a plate on whose lower surface the heating element in the shape of a tubular spiral body is attached and hung. The heating element is surrounded by a cylindrical air duct and the heating element and fan form a modular unit fastened below the front recess for easy access.

The advantages of this solution consist in particular in that in the first place the floor region is maintained warm and the heating power can be reduced by a good half. The cold air layer on the floor is displaced and the unnecessary heating up of the upper portion of the room can be avoided. A uniform temperature distribution at a satisfactory level increases the well-being of people. Should, as an example, air with a temperature of 25° C. in the ceiling region be mixed with the floor air of 17° C., a mixed air temperature of about 21° C. would result. Through uniform temperature distribution, especially in the total floor area of the residence, even with open doors, draft movements will be eliminated. The heretofore existing large heat losses through the room ceilings as a result of the stationary warm air below the room ceiling also are eliminated. Especially in the case of high rooms, with the device of the invention, it is not longer necessary, in order to save energy, to install lower room ceilings, or respectively, build-in intermediate ceilings. Besides, the built-in electrical heating element can provide a cost-efficient warming of a room during the change of seasons of the year (spring or, respectively, fall).

By locating at least two devices in a room removed from each other, a quick and very thorough mixing of room air is achievable, whereby the speed of the fan per device can be reduced, so that the fan runs very gently. Moreover, a fan with a small power requirement of, as an example, 20 watts can be installed. This order of magnitude suffices for producing the necessary throughput between 60 and 160 $m^3$/hr, whereby at the same time low operating costs are incurred.

The device according to the invention should in addition be a compact unit and should be built in an simple manner, and offer good value, and should be capable of being subsequently assembled in a room with a good fit quickly and easily.

For an easy assembly of the unit, it is appropriate to attach the control unit to a front panel which is equipped on its face with switches, indicating elements, a temperature sensor, etc., and which can be installed and attached in a front recess in the column. It is advantageous for that purpose that the front panel have on its rear side at least one board carrying electronic components and exhibit plug connectors reaching to the back wall of the column provided with a recess. In this manner, all the technical control and electronic components are provided on the front panel designed in the style of an insert.

Advantageously, below the control unit a fan producing an air flow in the column from the top to the bottom and a heating element are provided, so that the electronic components are not exposed to a harmfully high temperature.

Also, the fan and the heating element are advantageously attached together to a modular unit which is suspended in an intermediate floor which is welded into the column and indeed in a position below the recess for the front panel, so that through this recess the heating/-blowing unit can be suspended in the intermediate floor. Advantageously, the construction element possesses in addition a cylindrical air duct that encircles the heating element, so that the air moved from the top to the bottom passes in a concentrated manner and directly by the heating element.

The compact modular unit "column" consists of an upper and a lower column members, which two members are designed to be joined together. This has the essential advantage that the column can be fitted to different room heights. At the same time, the lower column member preferably contains the individual electronic components and such, while the upper column member is essentially empty. It is possible because of this to fit the column to the given room height by lengthening the upper column member. The gap resulting from the fastening together can be readily covered with a clamp-like member.

By connecting the device to an existing external heater it is further possible to operate the device of the invention or, respectively, the column in conjunction with an available external heater, with heating cost savings. It thus is possible to first heat the appropriate room as far as possible exclusively by the column alone or, respectively, to provide for a uniform temperature distribution, and only when the outside temperatures are of the kind that the desired temperature can no longer be reached or maintained by the column alone, to switch on the external heater. The addition of that heat can in this manner be to a large extent delayed, so that the heating cost or, respectively, energy cost savings of considerable magnitude are possible. Just during the change of seasons, it is sufficient through the means provided for equalizing the temperature to provide the heating element in the column with as little as 100 watts or less. A further advantage consists in that, especially in the case of central oil heaters but also with gas heaters, to reduce the amount of the combustion gases formed in the heating system and thus to contribute to the protection of the environment.

Further particularities and forms of the invention can be obtained from the following description, in which the invention is more closely described and explained by means of examples of embodiments represented in the drawings.

Figure 2:
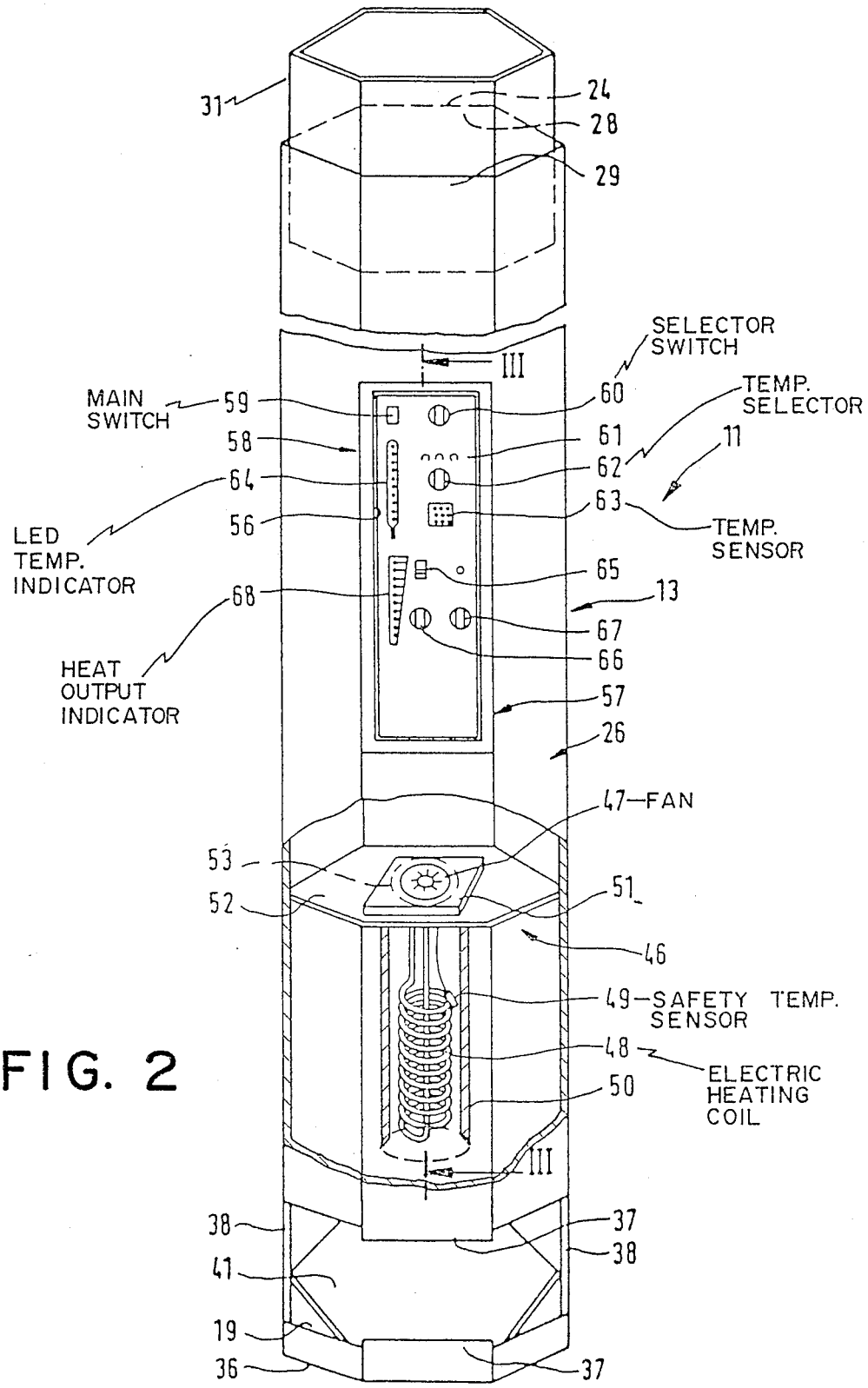
Figure 3:
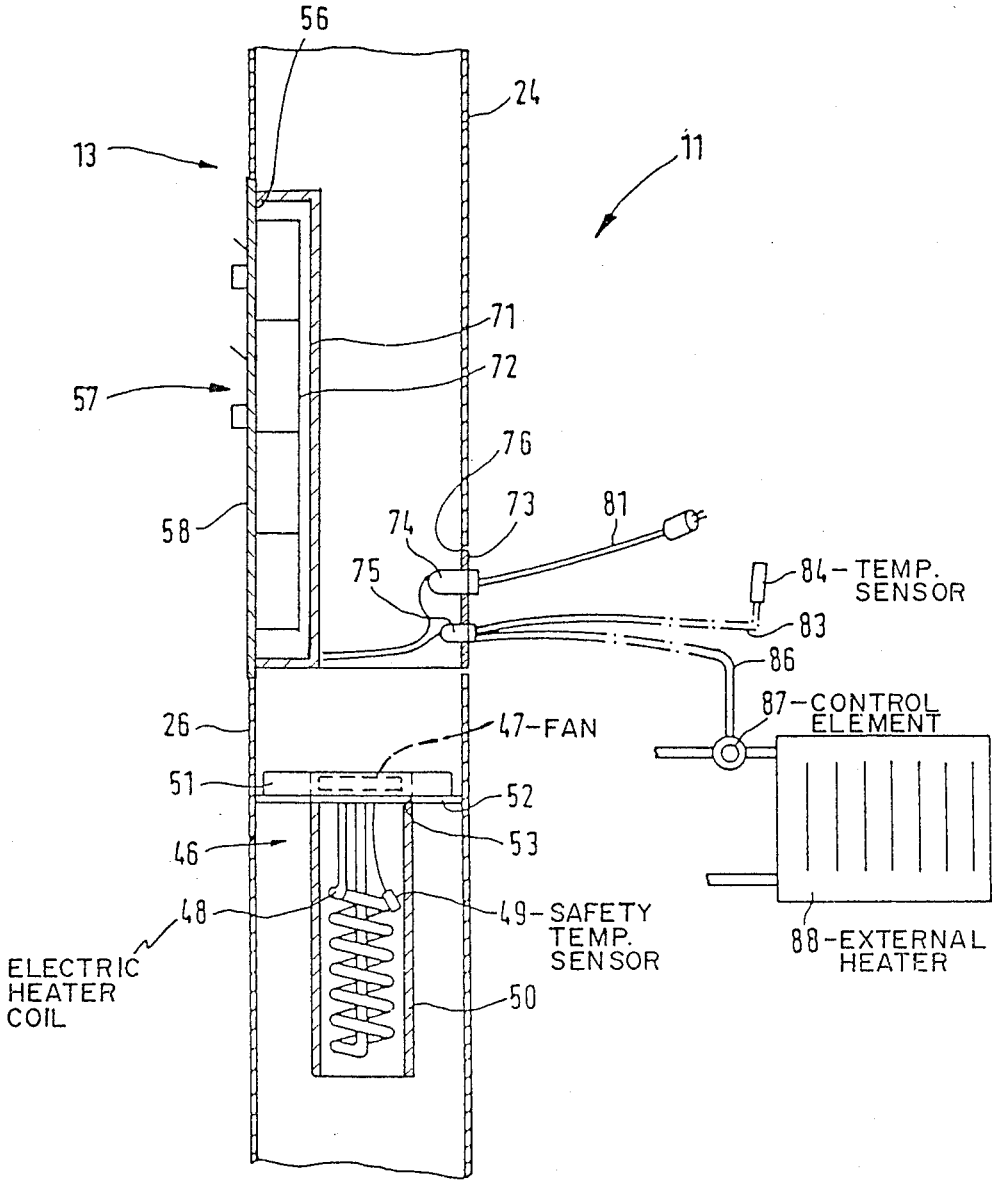
Figure 4:
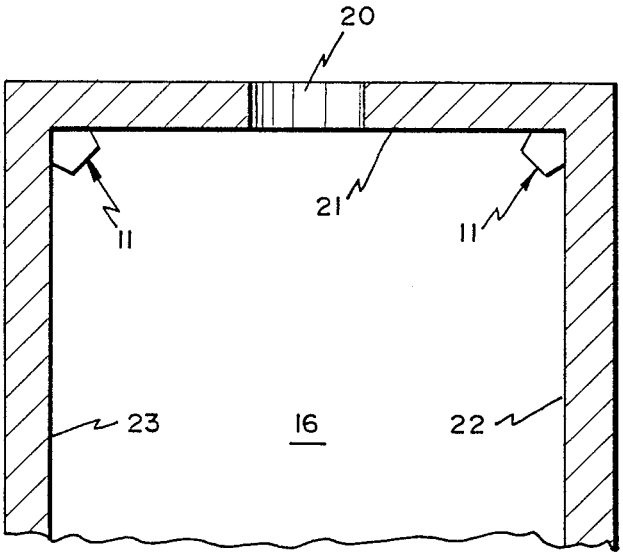

There is shown:

in FIG. 1 in a schematic representation a device built into the corner of a living room according to a preferred embodiment example of the present invention, in FIG. 2 in an enlarged, partly truncated and open representation, the lower member of the column according to FIG. 1, in FIG. 3 a sectional view along the line III—III of FIG. 2, together with a coupled external heater and in FIG. 4 a floor plan of an arrangement wherein heating devices are installed in the corners of a room at both sides of a window.

The device 11 shown in the drawing for the uniform heat retention or warming of an unheated or heated living room 12 by equalization of temperature distribution between the ceiling and floor regions possesses a column 13, which, standing upright, reaches from the floor 16 to the ceiling 17 of the living room 12. The column 13 is a hollow body in whose upper region an air inlet 18 and in whose lower region an air outlet 19 are provided. The hollow body possesses a cross-section in the shape of two trapezoids placed with their long bases against each other (FIG. 2), wherein the associated oblique sides are arranged perpendicularly to each other, whereby the column 13 fits into the living room corner of two walls 21, 22 abutting each other, and yet, room for receiving a cable, plug-in connectors, and such remains between the back wall 24 of the column 13 and the corner.

The column 13 consists of a lower column member 26 and an upper column member 27, which in each case consists of two elongated channel-shaped or trapezoid-shaped shells 28, 29. Both shells 28 and 29 of each member of the column 26, 27 are so shaped that the front shell 29 is bent on both sides to the rear beyond the vertical center plane of the column 13 and there fastened to the corresponding sidewalls of the rear shell 28. The shells 28, 29 are molded from a synthetic resin or bent from an aluminum sheet, which is provided with a decoration on its outer side.

The lower and the upper members of the column 26, 27 are so designed that they can be joined to each other. For that purpose, the lower half of the column 26 possesses a column member piece 31 having a cross-section smaller by its wall thickness, which is inserted and attached into the upper end and projects from the lower column member for a predetermined length. Over this projecting end of the column member piece 31, the upper column member 27 can be fitted with its lower end. The joint 32 resulting therefrom can be covered with a clamplike member 33, which can be clamped over the outer side of the front shell 29. The upper column member 27 can be easily cut to lengths, so that the column 13 can in this way be well fitted to the height of the given living room 12.

The upper column member 27 possesses a cover member, not shown. Near this cover member, the front shell 29 of the upper column member 27 possesses the air inlet 18, which essentially runs from one side edge to the other. This air inlet 18 can be covered with a grating 34, which is removably attached to the front shell 29, as will again be described in connection with the air outlet 19 of the lower column member. The grating 34 can be provided with a simple grating-like opening shown in FIG. 1, but it is also possible to design the individual elongated openings so that they open in the upward direction by means of projecting louvers.

The lower column member 26 possesses, in addition to the column member-connecting piece 31, a floor member 36 in the vicinity whereof the air outlet 19 is stamped out of the front shell 29 approximately from a side bevel to a side bevel. It is also apparent from FIG. 2 that the edge area of the air outlet 19 has in the front area and at the rear end of the oblique area tabs 37, 38 protruding inward, which serve for the removable attachment of a cover grating 39, which in inserted condition lies with its corresponding areas over the tabs 37 but grips behind the tabs 38. The grating 39 possesses, like the grating 34, either gratinglike openings or elongated openings covered with louvers and directed downward. Inside the lower column member 26, a sheet metal air guide 41 is arranged in the region of the air outlet 19, which extends downward at an inclined plane from the rear wall 24 to the bottom of the inner side of the front shell 29. In front of the air outlet 19 or in front of the air guide sheet 41, a dust filter can be arranged.

The lower column member 26 is provided with a modular unit 46, which consists of an axial ventilator or, respectively, fan 47, a heating element in the form of a tubular spiral heating body 48, a safety-temperature sensor 49 on the heating element 48, and a cylindrical air duct 50, which encircles the heating element 48, and a retaining plate 51, to which the fan, the heating element, and cylindrical air duct are attached. The modular unit is hung on an intermediate floor 52 which is fastened horizontally inside the lower column member 26. The intermediate floor 52 possesses a central opening 53, through which the cylindrical air duct 50 of the modular unit 46 can be inserted, so that the retaining plate 51 is supported by the intermediate floor 52.

For installing the modular unit 46, the intermediate floor 52 is accessible through a rectangular recess 56 in the planar, not oblique portion, of the front shell 29. In addition, into this recess 56, service and control equipment or, insert apparatus 57 are to be placed and fastened to the front shell 29. This apparatus 57 has a front panel 58, which is equipped on its face side with a main switch 59, a selector switch 60, a temperature difference indicator 61, a temperature selector switch 62, a temperature sensor 63, an LED temperature indicator 64, a circuit breaker 65, control knobs 66 and 67 for the ventilator or, respectively, the heating element, and an LED heat output indicator 68.

Additionally, the front panel 58 can be equipped with a timer switch and a cut-down or reduction switch. On its rear side, the front panel 58 carries within a housing 71 a plate or plates 72 packed with electronic components and with regulating and control units yet to be described with respect to their function. On one of the rear panels 73, connected to the front panel 58, plug-in or coupling members 74, 75 are attached. In the case where the service and control equipment 57 is inserted into the front shell 29 of the lower column member 26, the rear panel 73 lies in a recess 76 which is formed in the rear shell 28 of the lower column member 26.

According to FIGS. 1 and 2, the device 11 is connectable by means of a cable 81, which is connected to the coupling member 74, to a wall receptacle 82. Further, to the coupling member 75, a cable 83 is attached, which is connected to an external temperature sensor 84, which is placed near the floor level of the living room 12. In addition, to the coupling member 75 a cable 86 can be attached, which leads to the thermostat or magnetic valve comprising the control element 87 of a heater 84 of a central heating installation.

The function of the device 11 of the invention and its control are as follows:

By means of the selector switch 60, one chooses whether the device of the invention 11 should be operated manually or in one of four automatic modes, namely, A1 without internal/external heating or ventilator, or A2 with ventilator and internal heat, or A3 with external heating, or A4 with internal and external heating. With the temperature selector switch 62, the desired room temperature can be set, while the temperature sensor 63 measures the actual room temperature.

Let now the selector switch 60 be set in a given position A2 and the main switch ON. The ventilator 47 will be put in operation, so that air will be sucked in the direction of the arrows A in FIG. 1 from the ceiling region of the living room 12 and again exhausted in the direction of the arrows B at the floor level. Depending on the existing temperature difference between the preset desired value and the measured actual value, the ventilator 47 will be driven automatically at a higher or lower number of revolutions. This can be obtained in manual mode through the switch 66. The temerature difference can also be defined by the measured value of the temperature sensor 63 and the measured value of the external temperature sensor 84 at the floor level, since it is attempted to obtain a temperature equalization between the ceiling and the floor levels. For the corresponding installation, the temperature sensor 63 can indirectly detect the temperature prevailing at the ceiling level, since the air which is aspirated by the vetilator 47 comes from that region. The LED temperature indicator 64 shows the room temperature detected by the temperature sensor.

Should it be impossible to attain or maintain the preselected temperature exclusively by switching on the ventilator, then the electrical heating element 48 will be automatically switched on, which can also be done manually. Also, the instantaneous heat output will be shown on the LED indicator 68. This control or, respectively, adjustment is designed for the not yet too cold transition seasons.

At the end of winter or before the beginning of winter, it can occur that on given days or at given hours the output of the heating element 48, together with the temperature equalization by means of the fan 47 can no longer suffice for attaining or maintaining the desired room temperature, especially at the floor level. The selector switch will then be for that purpose set in position A4, whereby the result will be obtained that also that control function of the service and control apparatus 57 which is connected by the cable 86 to the valve 87 of the heating body 88 can be activated. The control function is so designed that the external heater 88, by comparison with the heating element 48 of the column 13, always can be switched on only secondarily. In other words, this means that in this automatic mode, first the fan 47 and then the heating element 48 is switched on. Only when by this means the room temperature cannot be reached or maintained, will the external heater 88 be switched on. When the room temperature is reached, then the external heater 88 will be disconnected first, while the heating element 48 and fan 47 of the device 11 remain switched on.

Switching of the external heater 88 can also be performed, when during operation with the fan 47 alone (without heater 48, a temperature difference between the ceiling and the floor of less than 2° C. cannot be obtained (position A3 of the switch 60).

It is understood that the control unit connected to the heater 88 can also be designed so that it can control room gas heaters or central oil or gas-hot water heating installations. In view of the desired adjusting and control technical function of the service and control apparatus 57, the design of the electronic components for the corresponding adjustment and control units will be readily apparent to one skilled in the art.

The described device 11 will be preferably installed in two places removed from each other, as an example, opposite corners of a room or in all four corners. It is essential for this choice that approximately 50–75% of the room's air can be circulated and mixed within a time of about 30 minutes at a reasonable noise and draft level. Alternatively, such devices 11 can also be installed on both sides of a window, wherein the warm air current is directed in each case towards the window and thus, in the case of windows that do not close sufficiently, warms up the entering cold air. Such an arrangement is shown in FIG. 4, wherein a room 16 having walls 21, 22 and 23 has a first device 11 installed at the corner of walls 21 and 22 and a second device 11 installed at the corner of walls 21 and 23 at the opposite side of the window 20 in wall 21.

We claim:

1. An arrangement for the uniform heating of a room by equalization of the temperature distribution between the ceiling and floor levels of the room, comprising:

at least one upright column extending from the ceiling to the floor of the room and forming an air channel, each said at least one upright column comprising an upper member including an upper air inlet to the channel and a lower member including a lower air outlet from the channel, each member comprising two channel-shaped shells fastened to each other, each said at least one upright column having a front recess, a front panel and an intermediate floor, said intermediate floor being fastened to the column below the front recess and being accessible through said front recess;

a modular unit attached to hang from said intermediate floor, said modular unit including a plate, a fan fastened to said plate, said fan creating an air current in said air channel, a cylindrical air duct, and a heating element in the shape of a tubular spiral body attached to hang from the lower surface of said plate, said heating element being surrounded by said cylindrical air duct; and a control unit attached to said front panel and located within said front recess, said modular unit and control unit being located between said upper air inlet and said lower air outlet, with said control unit being located closer to said upper air inlet.

2. The arrangement of claim 1, wherein a separate such upright column is located at at least two locations in a room and removed from each other.

3. The arrangement of claim 2, wherein the upright columns are located in the corners of a room.

4. The arrangement of claim 2, wherein the upright columns are located on both sides of a window in the room.

5. The arrangement of claim 2, further comprising: a temperature sensor arranged near the floor level, said control unit being connected to said temperature sensor.

6. The arrangement of claim 1, wherein each of said at least one upright column further comprises a rear wall provided with a recess, and wherein the front panel includes at least one board at the back thereof having electronic components, comprising parts of said control unit, thereon with plug-in connector parts extending to the rear wall of said column.

7. The arrangement of claim 1, wherein each of said at least one upright column further comprises a column connector piece connected to one of the lower or upper column members, over which the respective other column member is slidable lengthwise.

8. The arrangement of claim 1, wherein each of said at least one upright column further comprises a clamp-like member covering a joint between the upper and lower column members.

9. The arrangement of claim 1, wherein the upper column member of each column is provided only with the upper air inlet, and the lower column member is provided with the control unit, the modular unit, and the lower air outlet.

10. The arrangement of claim 9, wherein an inclined sheet metal air guide is provided in the region of the lower air outlet.

11. The arrangement of claim 10, wherein each one of the upper and the lower air outlets is covered by a removably attached grating.

12. An arrangement for the uniform heating of a room by equalization of the temperature distribution between the ceiling and floor levels of the room, comprising:

at least one upright column extending from the ceiling to the floor of the room and forming an air channel, each said at least one upright column comprising an upper member including a lower air outlet from the channel, each member comprising two channel-shaped shells fastened to each other, a each said at least one upright column having front recess, a front panel and an intermediate floor, said intermediate floor being fastened to the column below the front recess and being accessible through said front recess;

a modular unit attached to hang from said intermediate floor, said modular unit including a plate, a fan fastened to said plate, said fan creating an air current in said air channel, a cylindrical air duct, and a heating element in the shape of a tubular spiral body attached to hang from the lower surface of said plate, said heating element being surrounded by said cylindrical air duct; and a control unit attached to said front panel and located within said front recess, said modular unit and control unit being located between said upper air inlet and said lower air outlet, with said control unit being located closer to said upper air intlet; and an external heater having a control element, said control unit being connected to said control element of said external heater for controlling the operation of said external heater to provide a secondary source of heat to supplement to heat generated by said heating element.

13. The arrangement of claim 12, wherein said external heater comprises a hot water heating installation including a radiator and a valve forming said control element, and wherein the control unit is connected to said valve.

* * * * *